US005320182A

United States Patent [19]

Mendez

[11] Patent Number: 5,320,182

[45] Date of Patent: Jun. 14, 1994

[54] DOWNHOLE PUMP

[75] Inventor: Luis Mendez, Houston, Tex.

[73] Assignee: Baker Hughes Incorporated, Houston, Tex.

[21] Appl. No.: 926,139

[22] Filed: Aug. 5, 1992

Related U.S. Application Data

[63] Continuation of Ser. No. 642,139, Jan. 15, 1991, abandoned, which is a continuation of Ser. No. 345,342, Apr. 28, 1989, abandoned.

[51] Int. Cl.[5] ..... E21B 33/127

[52] U.S. Cl. ..... 166/387; 166/66.4; 166/106; 166/187; 417/423.3; 417/423.5

[58] Field of Search ..... 166/66.4, 65.1, 106, 166/187, 68, 105, 102, 103, 387; 417/423.3, 423.5, 423.7, 424.1, 410, 423.14, 359, 423.9, 414, 420, 35; 318/113

[56] References Cited

U.S. PATENT DOCUMENTS

| | | | |
|---|---|---|---|
| 1,906,771 | 5/1933 | Sandstone | 175/104 X |
| 1,923,015 | 8/1933 | Sandstone | 175/104 X |
| 2,441,894 | 5/1948 | Mennecier | 166/187 X |
| 2,455,022 | 11/1948 | Schmidt | 417/410 X |
| 2,552,433 | 5/1951 | Kirby, II | 166/187 X |
| 2,681,706 | 6/1954 | Pottorf | 166/66.4 X |
| 2,839,142 | 6/1958 | Huber | 166/187 X |
| 2,930,957 | 3/1960 | Cronberger | 318/113 X |
| 3,036,645 | 5/1962 | Rowley | 175/104 X |
| 3,066,739 | 12/1962 | Saurenman et al. | 166/187 X |
| 3,083,774 | 4/1963 | Peters et al. | 166/187 |
| 3,115,840 | 12/1963 | Feltus | 417/423.3 X |
| 3,209,835 | 10/1965 | Bourne, Jr. et al. | 166/187 X |
| 3,291,230 | 12/1966 | Cullen et al. | 175/104 X |
| 4,477,235 | 10/1984 | Gilmer et al. | 417/414 |
| 4,658,189 | 4/1987 | Trusock | 318/113 X |
| 4,748,361 | 5/1988 | Ohnishi et al. | 310/156 |
| 4,823,037 | 4/1989 | Abukawa et al. | 310/230 |
| 4,873,463 | 10/1989 | Jones | 310/68 B |

*Primary Examiner*—Hoang C. Dang
*Attorney, Agent, or Firm*—Melvin A. Hunn

[57] ABSTRACT

A downhole pump is provided having characteristics that permit it to be installed in a subterranean well in order to pump well fluids at a substantial pressure to operate a downhole tool, such as an inflatable packer. The pump is mechanically driven by motors whose diameter permits insertion through the well and whose output characteristics are suitable for driving the pump means. A single mounting bracket supports the motors in a housing and prevents counter rotation of the motor stators. The motors are immersed in a clean fluid inserted at the well surface and the clean fluid is maintained at the well hydrostatic pressure by a compensating piston.

35 Claims, 4 Drawing Sheets

DOWNHOLE PUMP

This is a request for filing a continuation application under 37 CFR 1.62 of prior application Ser. No. 642,139, filed on Jan. 15, 1991 entitled Downhole Pump now abandoned which is a continuation application under 37 CFR 1.62 of prior application Ser. No. 07/345,342, filed on Apr. 28, 1989 entitled Downhole Pump now abandoned.

BACKGROUND OF THE INVENTION

1. Field of the Invention

The invention relates to a motor and pump construction preferably dimensioned to permit the insertion of the motor and pump unit through a previously installed tubing string in a subterranean well. The pump is utilized to pump well fluids for the operation of a downhole tool, such as an inflatable packer.

2. Summary of the Prior Art

Inflatable packers which are operable by well fluids pressurized by a downhole motor driven pump have been previously disclosed. See, for example, U.S. Pat. Nos. 2,681,706 to POTTORF and 2,839,142 to HUBER. While each of these patents disclose a motor and pump unit which is insertable into a well through a previously installed casing and operates to pump well fluids to expand an inflatable packer, these prior art references furnish no information as to the electrical and mechanical characteristics of the motor that are required to effect an efficient operation of the downhole pump.

Conventional motors available in the market place are not designed to withstand the high temperature—high pressure environment encountered in subterranean wells at depths in excess of 10,000 ft. Such motors must be able to drive pumps to supply well fluids as the activating fluid for a down hole well tool, such as an inflatable packer. Such motors must be able to generate sufficient power to drive the pump means to produce a desired flow rate and overcome pressure differentials encountered in such well operations.

It is, accordingly, an object of this invention to provide an electric motor driven pumping unit preferably capable of being inserted through a previously installed tubing string which will function to efficiently pressurize well fluids for the operation of a downhole tool, such as an inflatable packer.

SUMMARY OF THE INVENTION

In accordance with this invention motor means are employed, preferably in series, and are both mechanically and electrically connected in series. The energy requirements of the pump, in terms of both torque and speed, are matched by the mechanical output of the motor means yet at the same time, the motor means are freely insertable through the well, hence are of substantially smaller size than that which could be expected to produce the total torque required by the pump. Furthermore, the total current drawn through the electric wireline is minimized by the electrical series connection.

Additionally, the motors are sealably mounted in axially stacked relationship within a housing containing both the pump means and the motor means. The motors are surrounded by a clean fluid, such as kerosene or water, which is applied at the surface and which is maintained at well hydrostatic pressure by a compensating piston arrangement. A single mounting bracket supports the lowermost motor or the lower end of the motor, if only one is used, within the housing and the stators of the motors are keyed to each other to prevent stator rotation. A heavy spring secures the stack in assembly.

Further objects and advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
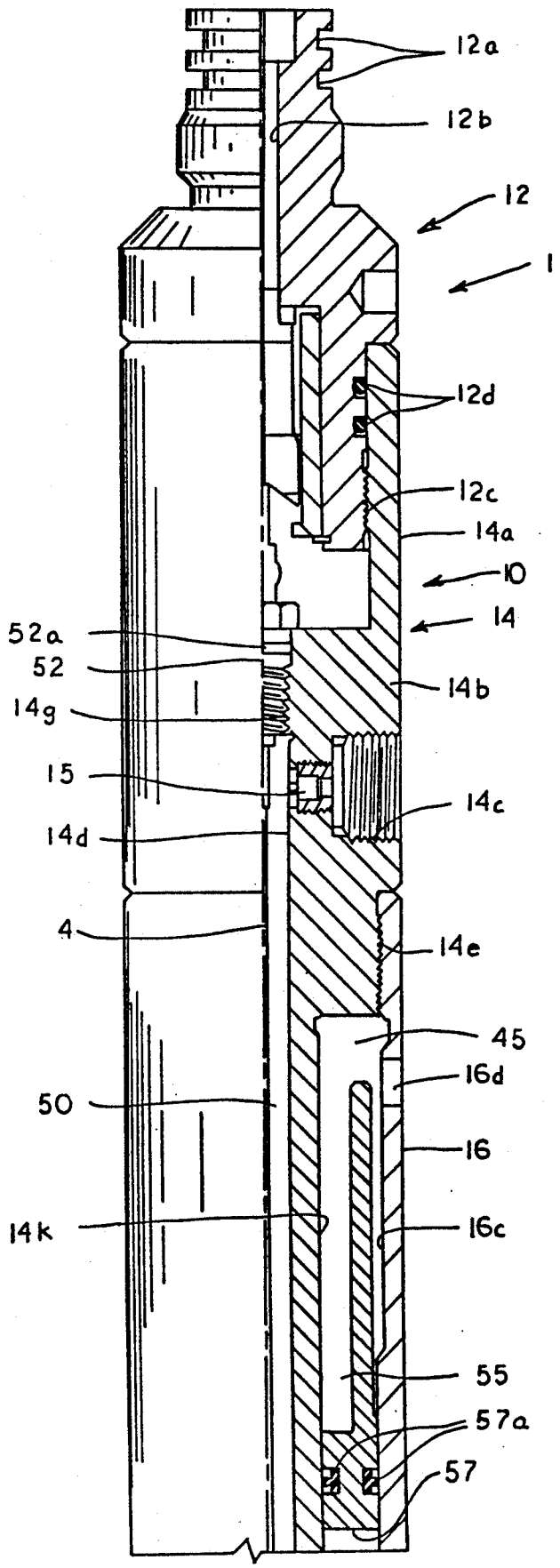
FIGS. 1A, 1B, 1C and 1D collectively constitute a vertical quarter sectional view of a combined motor and pump unit suitable for insertion through for example, a pre-existing tubing string to pump well fluids to a downhole tool, such as an inflatable packer.
Figure 1B:
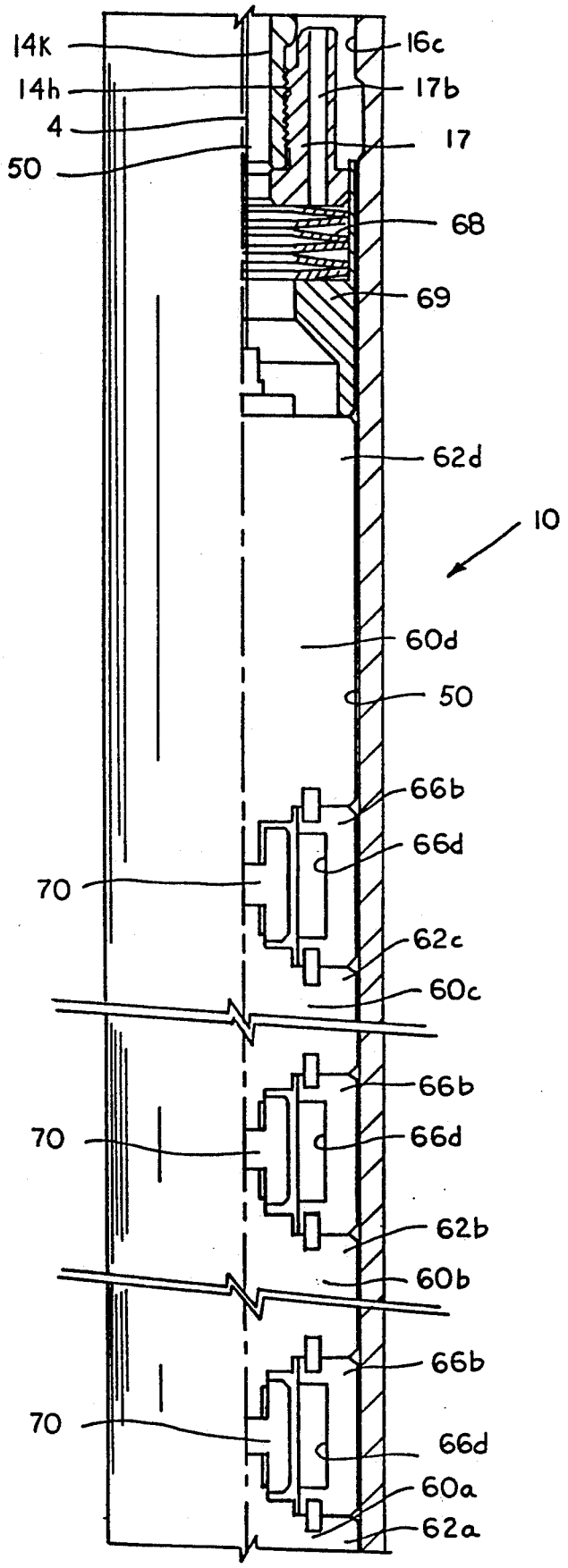

Referring to the drawings, a downhole apparatus 1 embodying this invention comprises a housing assemblage 10 which is connected in conventional fashion at its lower end to a well tool requiring pressured fluid, such as an inflatable packer 2, (FIG. 1D) which is only shown schematically since it is of entirely conventional construction.

Housing assemblage 10 comprises an upper sub 12 having wireline connectable means **12*a* formed on its upper end and defining a relatively small internal bore 12*b*. Upper sub 12 is secured by threads 12*c* to a counterbored portion 14*a* of an upper sleeve element 14. The threaded connection is sealed by O-rings 12*d***.

The medial portion **14*b* of the upper sleeve element 14 is provided with a radial port 14*c* which functions as a filling opening and communicates with the bore 14*d* of the upper sleeve portion. Additionally, immediately below the fill opening 14*c*, external threads 14*e* are provided which are connected to the top end of a coupling sleeve 16. Coupling sleeve 16 is provided with internal threads 16*a* at its lower end which threadably engage the upper end of an intermediate sleeve element 18 of housing 10 and these threads are sealed by an O-ring 18*a*. The lower end of the intermediate sleeve element 18 of the housing 10 is provided with internal threads 18*b* which are engaged with external threads provided on a coupling sub 20. Threads 18*b* are sealed by an O-ring 20*a*. The lower end of coupling sub 20 is provided with internal threads 20*b* which are secured to a bottom sleeve element 22 of the housing 10. Internal threads 22*a* in the bottom of the lower housing sleeve 22 provide a connection to a well tool requiring pressured fluid, such as the inflatable packer 2**.

Figure 1C:
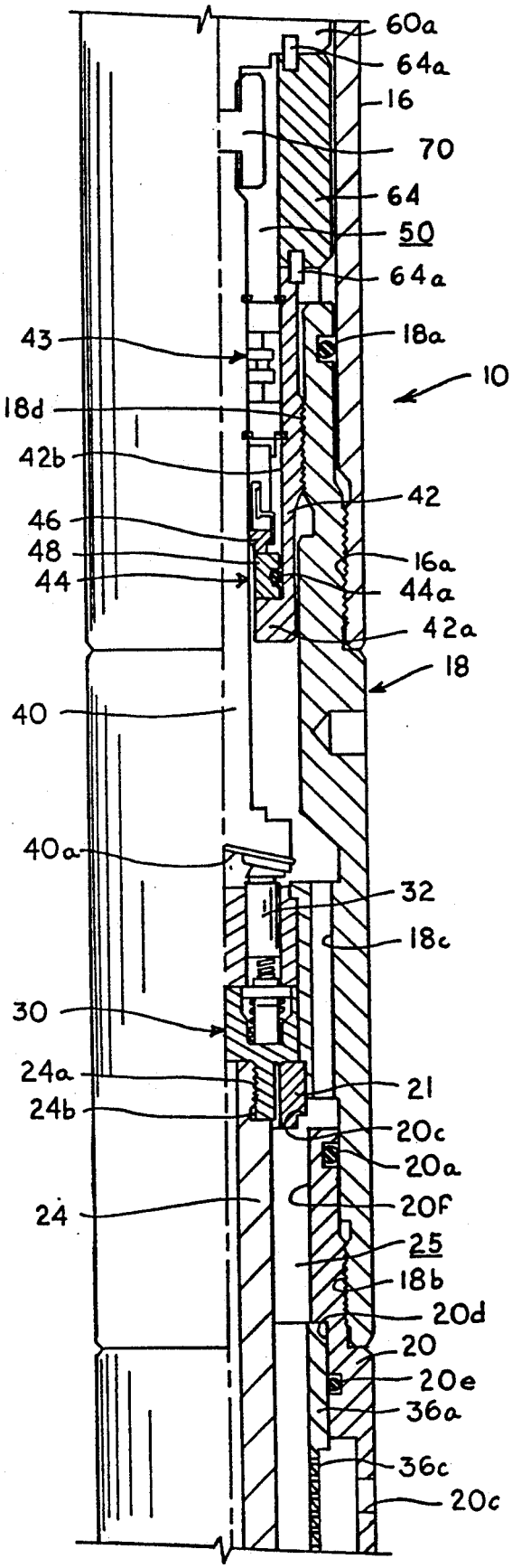
Figure 1D:
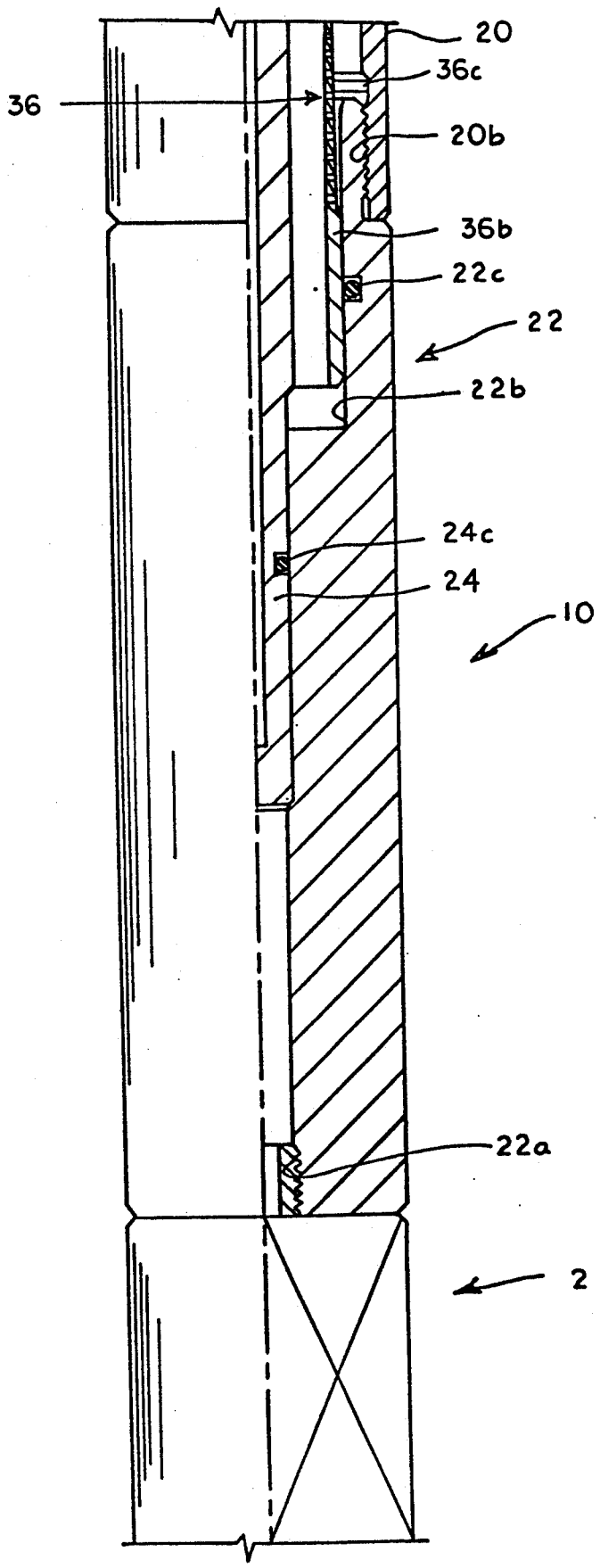

Referring to FIG. 1C, a conventional wobble plate pump 30 is mounted within the interior of housing 10 by a support ring 21 which is mounted on the upper end of an internally projecting shoulder of the connecting sub 20. The wobble plate pump 30 is of conventional construction comprising a plurality of peripherally spaced, plunger type pumping units 32 which are successively activated by an inclined wobble plate **40*a* carried on the bottom end of a motor driven shaft 40 which extends upwardly in the housing 10 for connection to the driving motors in a manner that will be hereinafter described. Rotation of shaft 40 effects the operation of the pumping plungers 32**.

Well fluids are supplied to the inlet side of the pumping plungers 32 through a radial port **20*c* provided in the lower end of the connecting sub 20. Well fluids then pass through a cylindrical filtering sleeve or screen 36 which has its upper end mounted in a counterbore 20*d* formed in the bottom end of connecting sub 20 and sealed thereto by an O-ring 20*e*. The bottom end 36*b* of filter sleeve 36 is sealably mounted in a counterbore 22*b* in the top end of sleeve element 22 and sealed by O-ring 22*c*. The medial portion 36*c* is perforated or formed of a screen. The filtered well fluids then pass upwardly through an annular passage 25 defined between the exterior of a downwardly projecting mandrel 24 and the internal bore surface 20*f* of the connecting sub 20. Mandrel 24 is provided at, its upper end with external threads 24*a* for securement to the bottom end of the pump 30. The well fluids then pass upwardly through a plurality of peripherally spaced, fluid passages 18*c* provided in the medial portion of the intermediate housing sleeve element 18 to where the fluids enter the pump unit 30 in conventional fashion. Fluids discharged from pump unit 30 pass downwardly through the bore of the depending mandrel 24 and thus into the inlet end of the well tool 2 for which pressured fluid is required. O-rings 24*b* and 24*c* prevent fluid leakage from the bore 24*a* of mandrel 24**. All of the apparatus heretofore described is entirely conventional, hence further detailed description thereof is deemed unnecessary.

Near the upper end of the intermediate housing sleeve 18, internal threads **18*d* are provided which mount an annular seal and motor mounting bracket 42. Bracket 42 has an internally projecting ledge portion 42*a* on which a conventional thrust bearing unit 43 and face seal unit 44 is supported. The face seal 46 engages the top end of a ring 48 which is sealably mounted in the bore 42*b* of the bracket 42 by an O-ring 44*a*. The face seal 46 thus functions as a bottom end seal for a chamber 50 which extends upwardly through the remaining portions of connecting sleeve 16 and upper housing sleeve portion 14 to terminate by a conventional electric wireline connector plug 52 sold under the trademark "Kemlon". Connector plug 52 is sealably inserted in the upper end of the reduced diameter bore portion 14*d* of the upper housing portion 14. Plug 52 is secured by internal threads 14*g* and sealed by an O-ring 52*a*. The electric wire portion 4 of an electric wireline (not shown) extends upwardly to the well surface and downwardly to the top motor 60*d*. The entire chamber, 50 may then be filled at the well surface with a clean lubricious fluid, such as kerosene, through the fill port 14*c* which is sealed by conventional check valve 15**.

Within the chamber 50, a plurality of substantially identical D.C. motors are mounted in axially stacked relationship and respectively designated in the illustrated embodiment as motors **60*a*, 60*b*, 60*c* and 60*d*. The lowermost motor 60*a* is connected to the top end of the pump driving shaft 40 by a conventional mechanical coupling 70, which is only shown schematically. The bottom motor 60*a* is connected to the next upper motor 60*b* by a conventional coupling 70 which is of the type that effects a mechanical connection. Connector 66*d* effects a series connection of the electrical power supplied to the various motors. Similarly, mechanical couplings 70 are connected between the motors 60*b* and 60*c*, and between motors 60*c* and 60*d***.

It is, of course, necessary that the stator elements or outer housings **62*a*, 62*b*, 62*c* and 62*d* of the respective motors be secured against counter-rotating forces when the respective motor is energized. To effect such securement, the lowermost motor 62*a* is connected to a support ring 64 which in turn is secured against rotation by downwardly extending pins or keys 64*a*. The lowermost pins 64*a* engage appropriate slots or holes provided in the upper end of the motor mounting bracket 42. Similar anti-rotation and supporting rings 66*b* are respectively provided between motor stators 62*a*, 62*b*, 62*c* and 62*d*. The only difference in the support rings 66*b*, and the lower support ring 64*a* is that the center portions of the upper rings 66*b* are provided with annular internal recesses 66*d*. Pins 64*a* are employed to non-rotatively couple each of the motors through the supporting rings 64 and 66*b***.

A stack of Bellville spring washers 68 are provided to urge a force transmitting ring 69 downwardly against the stator portion **62*d* of the uppermost motor 60*d*. The Bellville springs 68 are upwardly abutted by a spring anchor 17 which is secured to external threads 14*h* provided on the extreme lower portion 14*k* of the upper housing sleeve 14**.

Those skilled in the art will understand that the aforedescribed mounting arrangement for a plurality of D.C. motors within the limited confines the bore of the housing 10 provides a minimum of supporting structure for the stack of motors, yet insures that the stack is maintained in intimate mechanical contact.

The operation of the aforedescribed pump will be readily apparent to those skilled in the art from the foregoing description. As previously mentioned, the chamber 50 of the housing 10 is filled with a clean lubricious fluid, such as kerosene, at the well surface through the check valve 15 and the fill port **14*c*. This insures that the motors 50 are completely isolated from contact with well fluids. It is, however, highly desirable that the chamber 50 containing the kerosene be maintained at a pressure substantially equal to the hydrostatic pressure of the well fluids surrounding the pump 1 so as to prevent any undesirable contraction of the housing assemblage 10. To provide this feature, a reduced diameter, downwardly depending portion 14*k* is formed on the upper housing sleeve 14. This depending portion 14*k* cooperates with the inner wall 16*c* of the connecting sleeve 16 to define an annular fluid pressure chamber 45 within which an annular piston 57 is sealably mounted by seals 57*a*. A radial port 16*d* is provided in the wall of the upper portion of the chamber 55 to expose the upper end of the piston 57 to the hydrostatic pressure of well fluids surrounding the tool 1. The lower face of piston 57 is in communication with the chamber 50 by virtue of axially extending fluid passages 17*b* provided in the spring anchor 17. The piston 47 thus comprises a compensating piston and its position in the chamber 50 will vary with the external hydrostatic well pressure, effectively transmitting such well pressure to the trapped kerosene contained within chamber 50**.

The selection of the plurality of motors depends, of course, upon the input speed and torque requirements of the wobble plate pump unit 30. The motors **60*a*, 60*b*, 60*c* and 60*d* which may have D.C. voltage characteristics, must be of restricted diameter in order to fit within the bore of the housing assemblage 10** which, in turn, must be capable of ready passage through previously installed production tubing in the well or through casing. This diameter restriction means that conventional motors may have a limited torque output. For this reason, a plurality of such motors may be mechanically connected in series to multiply the torque outputs by a factor representing the total number of motors employed. At the same time, the motors may be electrically connected in series so that the applied voltage is distributed substantially equally across each of the plurality of motors. This reduction in voltage effects a substantial reduction in speed of the output shaft of the motors, hence eliminates the need for speed reduction gearing which has heretofore been necessary for the successful utilization of the motors in restricted diameter, downhole applications. Of course, the invention is not limited to use of motors insertable through production or other tubing, but, preferably such motors and pumps are anticipated to be used in such applications.

In a preferred example of this invention, each of the D.C. motors have a normal applied D.C. voltage of 0–120 volts and at such maximum voltage have a rated speed of 3600 rpm and develop a torque of 25 in. lbs. In the utilization of such motors in a pump of a character heretofore described, and assuming the four of such motors are employed, the applied voltage across each motor is on the order of 0–120 volts, the output speed is 2,000 rpm and the total torque developed is 100 in. lbs. These characteristics closely match the desired torque and speed input for the wobble type pump 30.

The motors may incorporate either a samarium cobolt magnet or a neodymium magnet. The use of such magnets is believed to contribute substantially to the energy available to drive the motors, defined as high inch pounds torque at a given rpm.

By use of the phrase "well fluids" herein it is intended to refer to those fluids which surround the well bore, either as naturally occurring fluids, and/or as components of drilling, completion or workover fluids introduced into the well for drilling, completion and/or workover applications. Their various contents and applications are well known to those skilled in the art.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by letters patent is:

1. A method of pressurizing downhole well fluids in a region of a subterranean well having an ambient well fluid pressure, said subterranean well having a production tubing string with a central bore having selected inner diameter suspended therein, comprising:

providing a housing including a motor chamber, said housing having an outer diameter less than said inner diameter of said central bore of said production tubing string;

providing a plurality of vertically aligned electric motors within said motor chamber;

providing a pump for receiving well fluids at ambient pressure from said subterranean well at an inlet and discharging well fluids from an outlet at a higher pressure;

providing a mechanical drive for mechanically coupling said plurality of vertically aligned electric motors to said pump;

lowering said housing into said wellbore through said central bore of said production tubing string to a selected region; and driving said pump with said mechanical drive to receive well fluid at said ambient well fluid pressure at said inlet and discharging said well fluids from said outlet at a higher pressure.

2. A method according to claim 1, further comprising:

providing an electric wireline;

suspending said housing through said central bore of said production tubing string in a selected location within said subterranean well on said electric wireline; and selectively supplying electrical current to a plurality of vertically aligned electric motors through said electric wireline.

3. A method according to claim 2, further comprising:

providing a series type electrical connection between said plurality of vertically aligned electric motors; and directing said electrical current serially to said plurality of vertically aligned electric motors through said series type electrical connection.

4. A method according to claim 3, wherein said series type electrical connection ensures a substantially equal application of voltage across each of said plurality of vertically aligned electric motors.

5. A method according to claim 1, further comprising:

providing a series mechanical connection between said plurality of vertically aligned electric motors and said mechanical drive; and combining torque outputs from said plurality of vertically aligned electric motors to provide a total torque output therefrom which is additively a multiple of the total number of electric motors employed in said plurality of vertically aligned electric motors.

6. A method according to claim 3, further comprising:

providing a series mechanical connection between said plurality of vertically aligned electric motors and said mechanical drive; and combining torque outputs from said plurality of vertically aligned electric motors to provide a total torque output therefrom which is additively a multiple of the total number of electric motors employed in said plurality of vertically aligned electric motors.

7. A method of pressurizing fluids in a subterranean well having a production tubing string with a central bore having selected inner diameter suspended therein, comprising:

providing a housing including a motor chamber, said housing having an outer diameter less than said inner diameter of said central bore of said production tubing string;

providing a plurality of vertically aligned electric motors within said motor chamber of said housing;

providing a pump for receiving well tool inflation fluid at an intake pressure at an inlet and discharging said well tool inflation fluid from an outlet at a higher pressure;

providing a mechanical drive for mechanically coupling said plurality of vertically aligned electric motors to said pump;

lowering said housing into said wellbore through said central bore of said production tubing string to a selected region; and driving said pump with said mechanical drive to receive said well tool inflation fluid at said intake pressure at said inlet and discharging said well tool inflation fluid from said outlet at a higher pressure.

8. A method according to claim 7, further comprising:

providing an electric wireline;

suspending said housing through said central bore of said production tubing string in a selected location within said subterranean well on said electric wireline; and selectively supplying electrical current to a plurality of vertically aligned electric motors through said electric wireline.

9. A method according to claim 8, further comprising:

providing a series type electrical connection between said plurality of vertically aligned electric motors; and directing said electrical current serially to said plurality of vertically aligned electric motors through said series type electrical connection.

10. A method according to claim 9, wherein said series type electrical connection ensures a substantially equal application of voltage across each of said plurality of vertically aligned electric motors.

11. A method according to claim 7, further comprising:

providing a series mechanical connection between said plurality of vertically aligned electric motors and said mechanical drive; and combining torque outputs from said plurality of vertically aligned electric motors to provide a total torque output therefrom which is additively a multiple of the total number of electric motors employed in said plurality of vertically aligned electric motors.

12. A method according to claim 9, further comprising:

providing a series mechanical connection between said plurality of vertically aligned electric motors and said mechanical drive; and combining torque outputs from said plurality of vertically aligned electric motors to provide a total torque output therefrom which is additively a multiple of the total number of electric motors employed in said plurality of vertically aligned electric motors.

13. A method of pressurizing fluids in a subterranean well having a production tubing string with a central bore having selected inner diameter suspended therein, comprising:

providing a housing including a sealed motor chamber, said housing having an outer diameter less than said inner diameter of said central bore of said production tubing string;

providing a plurality of vertically aligned electric motors within said housing;

providing a pump exterior of said motor chamber for receiving well fluids at ambient pressure from said subterranean well at an inlet and discharging well fluids from an outlet at a higher pressure;

providing a mechanical drive which extends from said sealed motor chamber;

sealing said mechanical drive at said sealed motor chamber;

mechanically coupling through said mechanical drive said plurality of vertically aligned electric motors with said pump;

lowering said housing through said central bore of said production tubing string to a selected region of said subterranean wellbore;

driving said pump with said mechanical drive to receive well fluid at ambient pressure at said inlet and discharge well fluid from said outlet at a higher pressure;

sensing said ambient pressure; and simultaneously adjusting pressure within said sealed mirror chamber in response to changes in said ambient pressure.

14. A method according to claim 13, further comprising:

providing an electric wireline;

suspending said housing through said central bore of said production tubing string in a selected location within said subterranean well on said electric wireline; and selectively supplying electrical current to a plurality of vertically aligned electric motors through said electric wireline.

15. A method according to claim 14, further comprising:

providing a series type electrical connection between said plurality of vertically aligned electric motors; and directing said electrical current serially to said plurality of vertically aligned electric motors through said series type electrical connection.

16. A method according to claim 15, wherein said series type electrical connection ensures a substantially equal application of voltage across each of said plurality of vertically aligned electric motors.

17. A method according to claim 13, further comprising:

providing a series mechanical connection between said plurality of vertically aligned electric motors and said mechanical drive; and combining torque outputs from said plurality of vertically aligned electric motors to provide a total torque output therefrom which is additively a multiple of the total number of electric motors employed in said plurality of vertically aligned electric motors.

18. A method according to claim 15, further comprising:

providing a series mechanical connection between said plurality of vertically aligned electric motors and said mechanical drive; and combining torque outputs from said plurality of vertically aligned electric motors to provide a total torque output therefrom which is additively a multiple of the total number of electric motors employed in said plurality of vertically aligned electric motors.

19. A method of pressurizing downhole well fluids in a pressurized region of a subterranean well having an ambient well fluid pressure, said subterranean well having a production tubing string disposed therein having a central bore defining an inner diameter, comprising:

providing a housing including a sealed motor chamber filled with a clean lubricous fluid, said housing having an outer diameter less than said inner diameter of said central bore of said production tubing string;

providing a plurality of vertically aligned electric motors within said motor chamber of said housing submerged in said clean lubricous fluid;

providing a pump exterior of said motor chamber for receiving well fluids at ambient pressure from said subterranean well at an inlet and discharging well fluids from an outlet at a higher pressure;

providing a mechanical drive which extends from said sealed motor chamber;

sealing said mechanical drive at said sealed motor chamber to maintain said clean lubricous fluid in said motor chamber and to prevent entry of said well fluids into the motor chamber;

mechanically coupling through said mechanical drive said plurality of vertically aligned electric motors with said pump;

lowering said housing through said central bore of said production tubing string to a selected location in said subterranean well;

driving said pump with said mechanical drive to receive well fluid at ambient pressure at said inlet and discharge well fluid from said outlet at a higher pressure;

sensing said ambient pressure; and simultaneously adjusting pressure within said sealed mirror chamber in response to changes in said ambient pressure to maintain said clean lubricous fluid at a pressure level corresponding to said ambient well fluid pressure.

20. A method according to claim 19, further comprising:

providing an electric wireline;

suspending said housing through said central bore of said production tubing string in a selected location within said subterranean well on said electric wireline; and selectively supplying electrical current to a plurality of vertically aligned electric motors through said electric wireline.

21. A method according to claim 20, further comprising:

providing a series type electrical connection between said plurality of vertically aligned electric motors; and directing said electrical current serially to said plurality of vertically aligned electric motors through said series type electrical connection.

22. A method according to claim 21, wherein said series type electrical connection ensures a substantially equal application of voltage across each of said plurality of vertically aligned electric motors.

23. A method according to claim 19, further comprising:

providing a series mechanical connection between said plurality of vertically aligned electric motors and said mechanical drive; and combining torque outputs from said plurality of vertically aligned electric motors to provide a total torque output therefrom which is additively a multiple of the total number of electric motors employed in said plurality of vertically aligned electric motors.

24. A method according to claim 21, further comprising:

providing a series mechanical connection between said plurality of vertically aligned electric motors and said mechanical drive; and combining torque outputs from said plurality of vertically aligned electric motors to provide a total torque output therefrom which is additively a multiple of the total number of electric motors employed in said plurality of vertically aligned electric motors.

25. An apparatus for use in a subterranean wellbore having a production tubing string disposed therein which has a central bore which defines an inner diameter, comprising:

a tubular housing which has an outer diameter which is less than said inner diameter of said central bore of said production tubing string to allow passage therethrough;

a plurality of vertically aligned electric motors within said tubular housing;

a pump for receiving an inflation fluid at an inlet at an intake pressure and for discharging said inflation fluid from an outlet to a pressure higher than said intake pressure;

a mechanical drive for mechanically coupling said plurality of vertically aligned electric motors to said pump; and a suspension member for lowering said tubular housing through said central bore of said production tubing string to a selected location within said subterranean wellbore.

26. An apparatus according to claim 25, wherein said suspension member comprises an electric wireline which selectively supplies said plurality of vertically aligned electric motors with an electric current.

27. An apparatus according to claim 25, further comprising:

a series type electrical connection between said plurality of vertically aligned electric motors;

wherein electric current is directed serially to said plurality of vertically aligned electric motors through said series type electrical connection.

28. An apparatus according to claim 25, further comprising:

a series mechanical connection between said plurality of vertically aligned electric motors and said mechanical drive; and wherein torque outputs from said plurality of vertically aligned electric motors are combined additively to provide a multiple of the total number of electric motors employed in said plurality of vertically aligned electric motors through said series type electrical connection.

29. An apparatus according to claim 25, further comprising:

a series mechanical connection between said plurality of vertically aligned electric motors and said mechanical drive; and wherein torque outputs from said plurality of vertically aligned electric motors are combined additively to provide a multiple of the total number of electric motors employed in said plurality of vertically aligned electric motors.

30. An apparatus according to claim 27, further comprising:

a series mechanical connection between said plurality of vertically aligned electric motors and said mechanical drive; and wherein torque outputs from said plurality of vertically aligned electric motors are combined additively to provide a multiple of the total number of electric motors employed in said plurality of vertically aligned electric motors.

31. An apparatus for pressurizing downhole well fluids in a pressurized region of a subterranean well having an ambient well fluid pressure to a pressure level above said ambient pressure, said subterranean well having a producing tubing string disposed therein with a central bore defining an inner diameter, comprising:

a housing including a motor chamber having an outer diameter which is smaller than said inner diameter of said central bore of said production tubing string;

a motor means disposed within said motor chamber for developing mechanical power, said motor means including a plurality of axially aligned electric motors;

a pump means, disposed within said housing and having an inlet and outlet, for receiving an inflation fluid at said inlet and discharging said inflation fluid from said outlet at a higher pressure;

a drive means, disposed between said motor means and said pump means, and including a rotatable shaft extending from said motor chamber at an opening to said pump means, for mechanically coupling said motor means to said pump means and transferring mechanical power from said motor means to said pump means;

seal means for sealing said motor chamber, including a seal element for sealing said motor chamber with said drive means;

pressure compensation means for maintaining said motor chamber at a pressure corresponding to said ambient pressure to prevent undesirable contraction of said housing; and a suspension member for suspending said housing in said subterranean well and providing electrical power to said motor means.

32. An apparatus according to claim 31, wherein said suspension member comprises an electric wireline which selectively supplies said plurality of vertically aligned electric motors with an electric current.

33. An apparatus according to claim 31, further comprising:

a series type electrical connection between said plurality of vertically aligned electric motors;

wherein electric current is directed serially to said plurality of vertically aligned electric motors through said series type electrical connection.

34. An apparatus according to claim 31, further comprising:

a series mechanical connection between said plurality of vertically aligned electric motors and said mechanical drive; and wherein torque outputs from said plurality of vertically aligned electric motors are combined additively to provide a multiple of the total number of electric motors employed in said plurality of vertically aligned electric motors through said series type electrical connection.

35. An apparatus according to claim 33, further comprising:

a series mechanical connection between said plurality of vertically aligned electric motors and said mechanical drive; and wherein torque outputs from said plurality of vertically aligned electric motors are combined additively to provide a multiple of the total number of electric motors employed in said plurality of vertically aligned electric motors.

* * * * *